United States Patent [19]

Holahan et al.

[11] 4,244,138

[45] Jan. 13, 1981

[54] ANIMATED ACTION TOY BIRD

[75] Inventors: Edward T. Holahan, Chicago; Burton C. Meyer, Downers Grove; Terry E. Webb, West Chicago, all of Ill.

[73] Assignee: Marvin Glass & Associates, Chicago, Ill.

[21] Appl. No.: 118,185

[22] Filed: Feb. 4, 1980

[51] Int. Cl.[3] ..... A63H 11/00

[52] U.S. Cl. ..... 46/124; 46/154; 46/192; 46/163

[58] Field of Search ..... 46/124, 123, 118, 126, 46/119, 154, 115, 117, 116, 192, 163

[56] References Cited

U.S. PATENT DOCUMENTS

| | | | |
|---|---|---|---|
| 2,038,460 | 4/1936 | Weiss | 46/123 X |
| 2,560,481 | 7/1951 | Rouse | 46/124 |
| 3,199,248 | 8/1965 | Suzuki | 46/118 X |
| 3,271,898 | 9/1966 | Glass et al. | 46/118 |
| 3,453,774 | 7/1969 | Breneman et al. | 46/268 |

FOREIGN PATENT DOCUMENTS

| | | | |
|---|---|---|---|
| 567526 | 3/1924 | France | 46/118 |
| 818673 | 8/1959 | United Kingdom | 46/126 |

*Primary Examiner*—Gene Mancene
*Assistant Examiner*—Mickey Yu
*Attorney, Agent, or Firm*—Mason, Kolehmainen, Rathburn & Wyss

[57] ABSTRACT

An animated action toy in the form of a prehistoric bird comprises a hollow body having a head at one end and a tail at the opposite end adapted for use in holding the toy in the hand for manipulation thereof. A pair of flappable wings are mounted on the body for control by a trigger. A beak is formed on the head including a beak member which is movably mounted to open and close and when so activated an internal sound generator is operated to produce a cackling sound. The bird includes a pair of talons extending from the underside of the body and each includes a plurality of claws which are manually controlled for gripping and releasing external objects.

16 Claims, 6 Drawing Figures

ANIMATED ACTION TOY BIRD

BACKGROUND OF THE INVENTION

1. Field of the Invention

The present invention relates generally to animated action toys or more particularly to an animated action toy in the form of a prehistoric flying reptile-like bird having a number of manually controlled mechanisms for closely simulating the action of a flying reptile.

2. BRIEF DESCRIPTION OF THE PRIOR ART

A wide variety of animated action toys have been developed over the years for use by young children and the like. Toys in the form of prehistoric monsters have also been provided.

OBJECTS OF THE INVENTION

It is an object of the present invention to provide a new and improved animated action toy for young children, and the like, and more particularly, an animated action toy in the form of a prehistoric flying reptile or bird. More particularly, it is an object of the present invention to provide a new and improved animated action toy which can be held in one hand and which includes a plurality of operating mechanisms for simulating the actions of a prehistoric flying reptile.

Another object of the present invention is to provide a new and improved animated action toy of the character described which includes a pair of flappable wings, a movable beak element and a pair of talons which are operable to grip and release external objects.

Yet another object of the present invention is to provide a new and improved animated action toy in the form of a prehistoric flying reptile which includes sound generating means actuated by a mechanism therein used for moving the beak of the bird.

Still another object of the present invention is to provide a new and improved animated action toy of the character described which may be held in one hand and manipulated thereby to flap its wings, open and close its beak, generate a cackling sound and open and close its talons for gripping and releasing external objects.

Still another object of the present invention is to provide a new and improved animated action toy in the form of a prehistoric flying reptile which closely resembles in action and appearance the pterodactyl.

Still another object of the present invention is to provide a new and improved animated action toy of the character described which includes a trigger element for flapping a pair of wings, a plunger element for causing talons of the bird to open and close and a lever element closely adjacent thereto for opening and closing the beak and generating a cackling sound.

Still another object of the present invention is to provide a new and improved animated action toy of the character described which is formed of molded plastic material and which is light in weight, easy to handle and manipulate and which includes talon assemblies wherein the fore and aft claws are adapted to snap open and snap closed around an object clutched thereby.

SUMMARY OF THE INVENTION

The foregoing and other objects and advantages of the present invention are accomplished in a new and improved animated action toy in the form of a prehistoric flying reptile and including a hollow body having a head at one end and a tail at the opposite end adapted for use in holding and manipulating the toy in one hand.

The toy includes a pair of flappable wings mounted on the body and a beak on the head including a beak member mounted to open and close with respect to a fixed beak member and including manually controllable mechanism for operating the beak and at the same time generating a sound similar to the cackle of a bird. The bird also includes a pair of talons each having fore and aft claws which are pivotal relative to one another to snap between open and closed positions for gripping and/or releasing external objects. The toy bird is relatively light in weight and easy to handle and manipulate by young children and the like.

BRIEF DESCRIPTION OF THE DRAWINGS

For a better understanding of the present invention, reference should be had to the following detailed description taken in conjunction with the drawings in which.

DESCRIPTION OF THE PREFERRED EMBODIMENT

Figure 1:
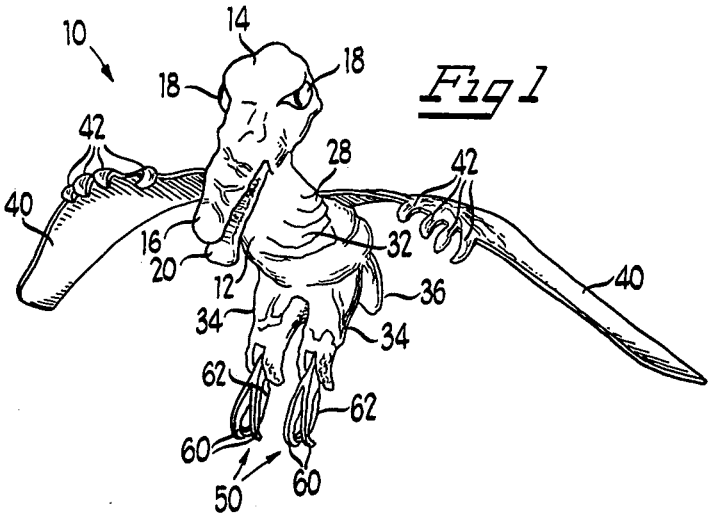
FIG. 1 is a front perspective view of a new and improved animated action toy in the form of a prehistoric flying reptile constructed in accordance with the features of the present invention.

Referring now more particularly to the drawings therein is illustrated a new and improved animated action toy in the form of a prehistoric flying reptile known as the pterodactyl constructed in accordance with the features of the present invention and referred to generally by the reference numeral 10. The bird includes an elongated, hollow, longitudinally extending body portion 12 preferably formed of molded plastic material and styled with the design and dress of a prehistoric flying reptile with a large head 14 at the upper end. The head is formed to include a fixed upper and outwardly protruding beak having teeth-like serrations 16*a* along the lower edge thereof and a pair of eyes 18 on opposite sides.

The bird includes a movable lower portion of a beak indicated by the reference numeral 20 including teeth 20*a* along opposite upper edges and pivotally secured to the head on a transverse pivot pin 22 for movement toward and away from the upper fixed beak portion 16. Normally, the lower beak 20 is biased towards a closed position by an internal rubberband 24 having opposite ends looped around transverse pins 16*b* and 20*b* extending between opposite internal surfaces of the respective upper and lower beak elements 16 and 20.

As indicated, the lower beak 20 is biased toward the closed position by the rubberband 24 and is movable to an open position by pivotal movement in a counterclockwise direction as indicated by arrow "A" around the pivot axle 22 supporting the same in the head structure. The inner end portion of the lower beak 20 extends into an opening on the underside of the upper beak 16 forming a throat portion. The body further includes a neck 26 extending downwardly of the head towards an enlarged, main body portion 28 having a relatively flat, upper back surface 30 with a downwardly protruding breast-like under portion 32 having a pair of elongated hollow drumstick-like leg portions 34 entending forwardly and downwardly on opposite sides of a longitudinal centerline of the bird. The legs or hollow drumsticks 34 slope forwardly away from the lower wall portion of the breast or body in a direction generally parallel of the upper beak element 16 on the head 14.

Rearwardly of the drumsticks, the body is shaped to provide a rearwardly and downwardly sloping tail 36 having a handle-like lower end portion 38 which provides a convenient means for grasping the bird and manipulating the mechanisms thereof with one hand.

Figure 2:
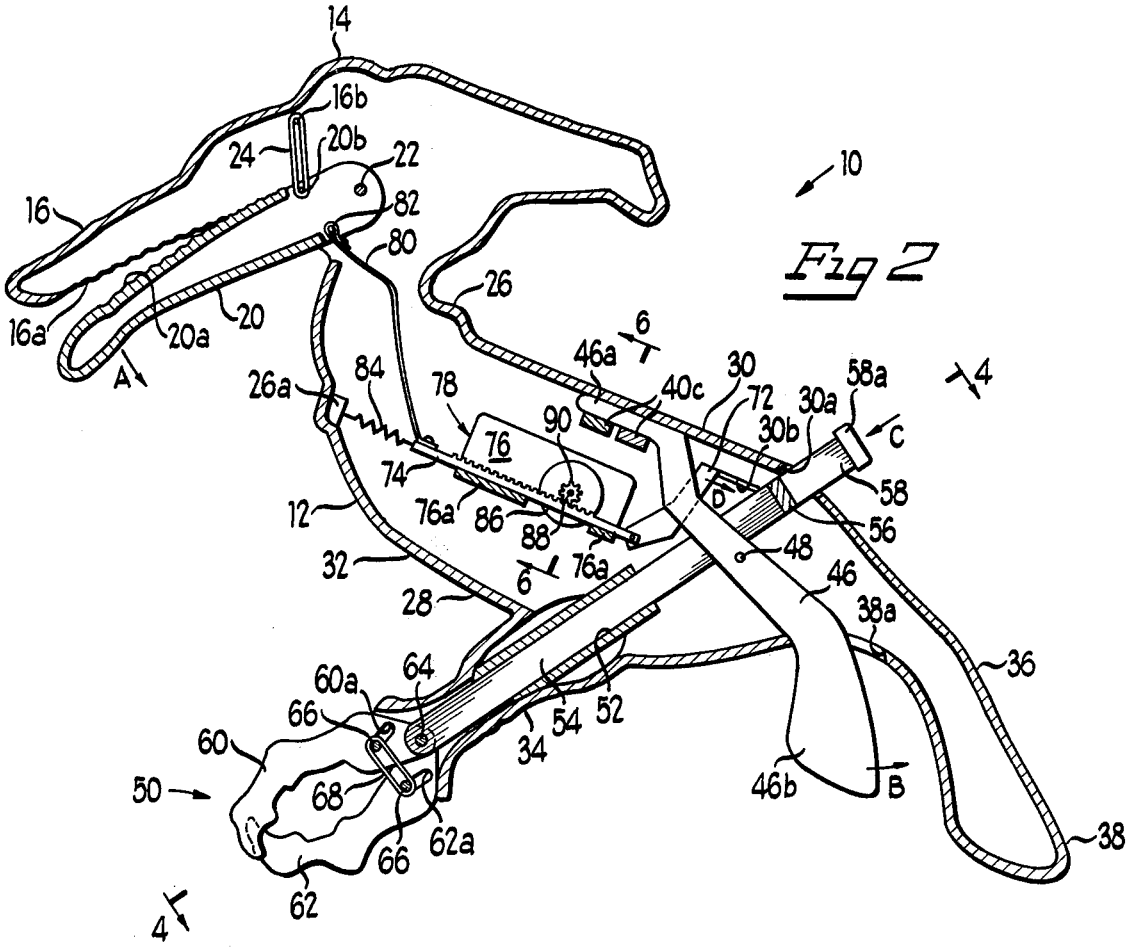
FIG. 2 is a longitudinally extending cross-sectional view taken through the body of the bird and showing internal components therein.
Figure 6:
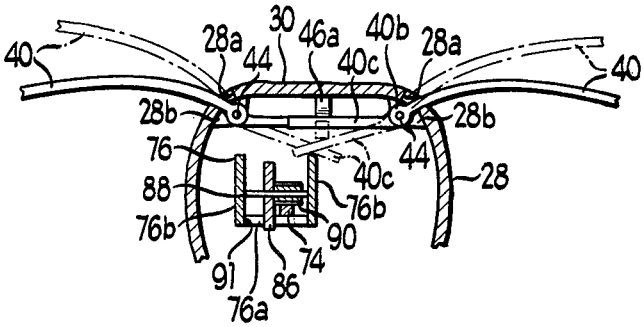
FIG. 6 is a fragmentary transverse cross-sectional view taken substantially along lines 6—6 of FIG. 2.

In accordance with the present invention, the bird is formed with a pair of relatively large, laterally outwardly extending, flappable wings 40 having claw portions 42 on the leading edges thereof as the ancient flying reptiles were believed to have been provided with. Each wing includes an inwardly extending support or base portion **40*a* which passes through an elongated slot 28*a* formed in the adjacent side wall of the body adjacent an upper level just below the relatively flat, back wall 30. At opposite ends of each of the side slots 28*a* is provided an inwardly extending, integrally formed bracket 28*b* for supporting a pin 44 extended through a cylindrical boss 40*b* provided on the wing along the inwardly extending support portion 40*a*. Each wing 40 is pivotable up and down with respect to a respective longitudinal axis on one side of the center of the body and the wing slots 28*a* are dimensioned to be wide enough to accommodate the pivotal movement of the wings through a limited angular range as shown in FIG. 6. Upper and lower edges of the slots serve as stop surfaces to limit the amount of pivotal movement of the wings. In accordance with the invention, each wing includes an activator tab 40*c* extending inwardly of the supporting pivot pin and beyond the centerline of the body. The outer end portions of the wings are curved downwardly and tend to droop so that gravity acting on the wings as a whole tends to move the elements 40*c* into an upper position as shown in FIGS. 2 and 6 generally parallel against the upper back 30**.

In order to flap the wings, the bird 10 includes a trigger-like lever 46 mounted for pivotal movement on a transversely extending axle pin 48. The lever is movable between a first position as shown in FIGS. 2 and 6 wherein a forward end **46*a* of the trigger is biased upwardly against the inside surface of the upper back 30 by the force exerted from the wing elements 40*c* as shown. A lower trigger-like rear end portion 46*b* extends downwardly and rearwardly of pivot axle through an opening 38*a* provided in the bottom wall of the handle portion 38 of the tail 36. The trigger end of the lever 46 is adapted to be squeezed upwardly toward the tail as indicated by arrow "B" in a counterclockwise direction and this action depresses the wing elements 40*c* downwardly to flap the outwardly extending portions of the wing upwardly toward an upper position as shown in dotted lines of FIG. 6. When trigger pressure is released, the force of gravity acting on the wings causes the wings to return to the lower, downwardly drooping position of FIG. 1. In this position, the lower ends of the wings are at a level approximately the same as that of the lower end of the handle 38 of the tail 36 and this arrangement provides support so that the flying bird may be placed on a supporting surface and will stand in an upright position as shown in FIG. 1**.

Figure 4:
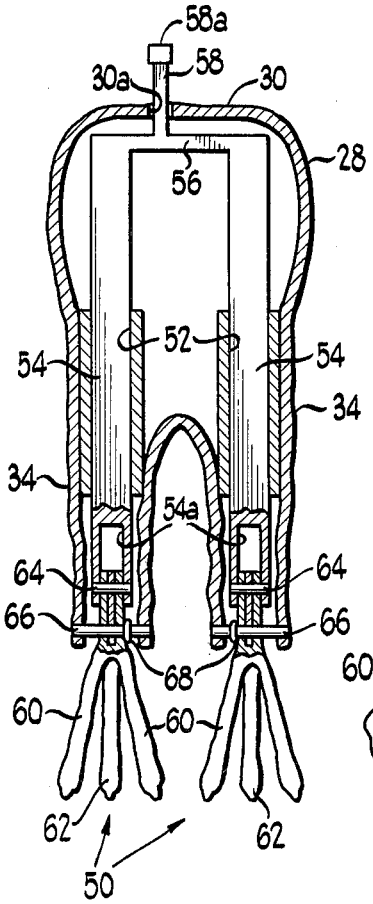
FIG. 4 is a transverse cross-sectional view taken substantially along lines 4—4 of FIG. 2.

In accordance with the present invention, the bird 10 also includes a pair of talon assemblies 50 which extend downwardly from the open lower ends of the drumstick-like legs 34 on the body. The legs serve as open ended sheathes for aligning and supporting a pair of hollow tubular sleeves or cylinders 52 in laterally spaced apart parallel alignment on opposite sides of the centerline of the body. The sleeves provide support for a pair of depending piston-like rod elements 54 joined together at the upper end by an integral cross member or bight portion 56 as shown in FIG. 4. A plunger 58 is provided for moving the elements 54 longitudinally of the drumstick-like sheathes 34 and includes a cap **58*a* on the upper end designed to accommodate a thumb or finger. As shown in FIG. 4, the the plunger is integrally formed on the bight portion 56 and is offset from the center thereof to extend upwardly through an opening 30*a* formed on one side of the center in the upper back of the body. When the plunger cap is pressed downwardly by the thumb or finger as indicated by arrow "C", the legs 54 slide downwardly in the sleeves 52 of the drumstick-shaped sheathes 34**.

Each talon assembly 50 includes a two-toed front claw element 60 and a single-toed rear claw element 62 and the claws are mounted for relative pivotal movement between a closed or gripping position (FIG. 2) and an open or pickup position (FIG. 5) on a support pin 64 extending between opposite sides of slots or recesses **54*a* formed in the lower end portions of the rod-like elements 54 as shown in FIG. 4. Relative pivotal movement of the front and rear claw of each talon assembly 50 is tempered by a pair of transverse guide pins 66 extending between opposite sides of each element. These guide pins pass through elongated slots 60*a* and 62*a*, respectively, in the front and rear claws and the pins provide support for opposite ends of a rubberband element 68 positioned to engage the rounded lower end of the element 54 when the plunger 58** is forced downwardly to open the claws.

Figure 5:
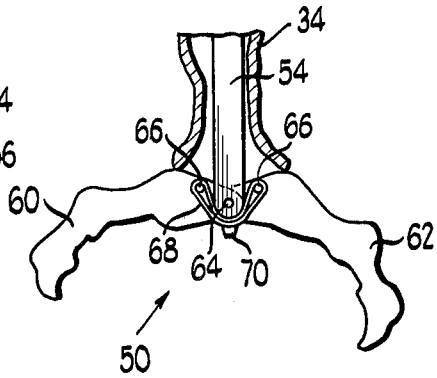
FIG. 5 is a fragmentary cross-sectional view similar to a portion of FIG. 2 but illustrating a talon assembly of the bird in an extended open position for picking up an external object.

As indicated in FIGS. 2 and 5, the supporting mechanism for the front and rear claw 60 and 62 of each talon assembly 50 comprises an overcenter-type toggle locking mechanism wherein the rubberband 68 tends to retain the claws either in an open position (FIG. 5) or in a closed position (FIG. 2). Between these positions, the rubberband causes the claws to snap in one direction or the other to open or close. Action of the claws is initiated by downward pressure on the plunger 58 or by upward retraction. thereof. As illustrated in FIG. 5, one or both of the claws 60 and 62 of each talon assembly 50 is formed with a contact button 70 adjacent the pivot pin 64 and projecting downwardly in alignment with the element 54 when the claws are open as shown in FIG. 5. When the button 70 is moved into contact with an object to be picked up, it aids in retracting the element 54 upwardly so that the pin 64 moves past the overcenter toggle locking position between the pins 66. When this occurs, the front and rear claws snap toward the closed position to grasp and pick up the external object in contact with the button 70. Similar action can also be achieved by gripping the upper cap **58*a* on the plunger and retracting the plunger 58** upwardly to snap the claws shut or closed around the external object.

When the plunger is forced downwardly by the thumb or finger, the elements 54 move the pivot pin 64 past the line of center between the pins 66 and as soon as movement past the centerline is achieved, the claws 60 and 62 tend to snap open and remain open.

Figure 3:
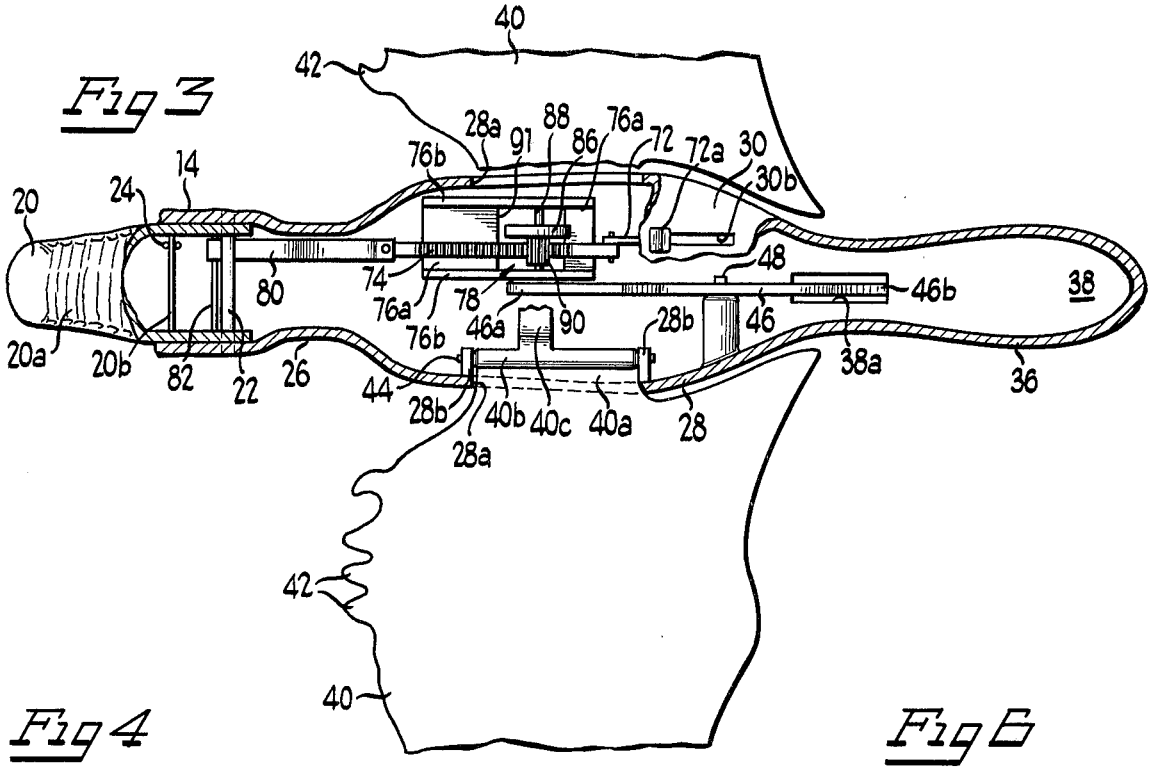
FIG. 3 is a fragmentary cross-sectional view taken to extend longitudinally through the body portion of the bird at right angles to the sectional view of FIG. 2.

In accordance with the present invention, the lower beak 20 is adapted to be manually controlled for movement toward an open position by means of a finger controlled element 72 having an enlarged projection 72*a* at the upper end (FIG. 3) and offset laterally to one side of the control plunger 58 for the talon assemblies 50. An outer end portion of the element 72 is slidably disposed in a longitudinal slot 30*b* formed in the back wall 30 of the body and the finger engaging portion 72*a* is readily manipulated rearwardly and guided longitudinally by engagement with the side surfaces of the slot 30*b*. At the inner end, the control element 72 is pivotally interconnected to an elongated, toothed rack element 74 formed of flexible material and guided for reciprocal longitudinal sliding movement on a bottom or bight portion 76*a* of a channel-shaped structure 76. The channel provides a base of a sound generator 78 centrally disposed in the interior of the body 28 as shown in FIGS. 2, 3 and 6. At the forward end, the rack is connected through a flexible linkage member 80 to a pin 82 on the movable lower beak member 20 at a point forwardly of the beak support pin 22. Accordingly, when the control element 72*a* is moved rearwardly, the rack 74 is moved in the direction of arrow "D" (FIG. 2) and this causes the lower beak element 20 to pivot open in a counterclockwise direction as indicated by the arrow "A". A bias spring 84 is connected to the forward end of the flexible rack 74 and normally returns the rack to a forward position after manual pressure on the actuator element 72 is released. The forward end of the spring is secured to an internal lug 26*a* on the inside of the neck 26 in line with the longitudinal axis of the flexible rack 74. In accordance with the invention, the sound generator 78 includes a flywheel 86 supported on an axle pin 88 extending between opposite flanges 76*b* of the base structure 76 as shown in FIGS. 3 and 6. The flywheel 86 is rotated by a gear 90 positioned to engage the teeth on the upper surface of the elongated rack element 74 so that the flywheel will spin rapidly in a counterclockwise direction as the control element 72 is moved rearwardly in the direction of arrow "D". As this occurs, the flywheel absorbs energy and spins rapidly and when the pressure on the member 72 is released, the spring 84 starts to return the rack 74 forwardly toward the rest position to close the lower beak 20 of the bird's mouth. Engagement of the spinning teeth on the flywheel gear 90 with the teeth on the rack 74 generates a cackling-type sound from the bird and this sound is achieved through vibration of the elongated flexible rack as the gear teeth and rack contact one another in opposite directions. In order to permit flexible movement of the rack, a lower segment of the bight portion 76*a* of the base 76 is slotted out as at 91 and this slot accommodates the flywheel and permits the flexible rack 74 to be deflected downwardly away from the teeth on the spinning gear 90 as the rack is moved forwardly by the spring 84 to generate the cackling sound. When the element 72 is manipulated rearwardly by the thumb or finger to retract the rack 74 rearwardly, the flywheel 86 begins to spin as the lower beak element is opened. Upon release of pressure on the finger element 72*a*, the spring 84 becomes effective to return the rack forwardly and this causes a cackling sound to be generated and the lower beak element to close.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. An animated action toy in the form of a flying bird, comprising:

a hollow body having a head at one end and a tail at the opposite end adapted for use in holding the toy in the hand for manipulation thereof;

a pair of wings mounted on said body;

a beak on said head including a beak member mounted for movement to open and close with respect to another beak member, a pair of talons extended from an under side of said body, each talon including a plurality of claws for gripping and releasing external objects, first operator means on said body manually activated to move said claws of said talons between open and closed positions for gripping an external object, and means for biasing said claws of said talons to pivot when said first operator means is released, said claws of each talon being pivotally interconnected and mounted for movement past an over center toggle locking relation when pivoted between said open and said closed positions whereby said biasing means is effective to retain said claws in either said closed or said open position.

2. The toy of claim 1 including a sound generator actuated upon movement of said beak member.

3. The toy of claim 1 wherein said first operator means is manually movable to close the claws of each talon around said external object.

4. The toy of claim 1 or 3 wherein said first operator means includes push button means depressible toward said body for opening the claws of said talons.

5. The toy of claim 1 wherein manual movement of said first operator means in one direction relative to said body moves said claws of each talon to pivot past said toggle locking relation while moving from said closed position to said open position.

6. The toy of claim 5 wherein manual movement of said operator means in an opposite direction moves said claws of each talon to pivot past said toggle locking relation while moving from said open position to said closed position.

7. The toy of claim 1 wherein said claws of each talon are bistable in either a closed or an open position until said first operator means is actuated manually to move said claws toward an opposite position.

8. The toy of claim 1 wherein each of said wings is mounted for pivotal flapping movement on said body and including manual wing operator means for pivoting said wings to move relative to said body.

9. The toy of claim 8 wherein said wing operator means comprises a lever mounted for pivotal movement on said body including a trigger portion movable toward and away from said tail.

10. The toy of claim 9 wherein said trigger portion extends along an under side of said tail and is moved toward said tail to flap said wings upwardly.

11. The toy of claim 9 wherein each wing is mounted for pivotal movement about a pivot axis extending longitudinally of said body and includes an inside portion extending inwardly of said pivot axis, said lever including a forward portion engageable with said inside portion of each wing for flapping said wing upwardly when said trigger portion is squeezed toward said tail.

12. The toy of claim 1 including second operator means manually actuated and connected to pivot said movable beak member relative to said other beak member.

13. The toy of claim 12 including means for biasing said movable beak member toward a closed position with respect to said other beak member and wherein actuation of said second operator means is effective to open said beak by movement of said movable beak member away from said other beak member.

14. The toy of claim 12 including a sound generator in said body activated by said second operator means when said movable beak member is moved.

15. The toy of claim 14 wherein said sound generator includes an elongated, flexible toothed rack element adapted to drivingly engage a gear portion of a rotatable flywheel upon movement of said rack in one direction for rotating the same.

16. The toy of claim 15 wherein said rack is deflectable upon movement in an opposite direction as the teeth thereof engage the teeth of said gear portion of said rotating flywheel to generate a crackling sound.

* * * * *